United States Patent [19]

Hansen

[11] 4,062,814

[45] Dec. 13, 1977

[54] LOW-FOAMING COLD-WATER GLASSWASHING DETERGENT

[75] Inventor: Gregory Blair Hansen, Royal Oak, Mich.

[73] Assignee: BASF Wyandotte Corporation, Wyandotte, Mich.

[21] Appl. No.: 733,421

[22] Filed: Oct. 18, 1976

[51] Int. Cl.[2] ..... C11D 1/66

[52] U.S. Cl. ..... 252/529; 252/89 R; 252/156; 252/173; 252/548; 252/DIG. 1; 252/DIG. 10; 252/DIG. 14

[58] Field of Search ..... 252/89, 156, 173, 529, 252/548, DIG. 1, DIG. 10, DIG. 14

[56] References Cited

U.S. PATENT DOCUMENTS

| | | | |
|---|---|---|---|
| 2,976,248 | 3/1961 | Otrhalak | 252/156 |
| 3,700,599 | 10/1972 | Mizuno et al. | 252/99 |
| 3,956,161 | 5/1976 | Woodward | 252/156 |

*Primary Examiner*—Thomas J. Herbert, Jr.
*Assistant Examiner*—Bruce H. Hess
*Attorney, Agent, or Firm*—John W. Linkhauer; Bernhard R. Swick; Robert E. Dunn

[57] ABSTRACT

A composition affording satisfactory performance in commercial glassware-cleaning equipment, operating with room-temperature water, is obtained with a composition containing not only a satisfactory proportion of caustic but also a very low-foaming nonionic surfactant and, as a solubilizer for such surfactant, a cycloaliphatic $C_{21}$ dicarboxylic acid or one of its alkali-metal or ammonium salts.

14 Claims, No Drawings

LOW-FOAMING COLD-WATER GLASSWASHING DETERGENT

BACKGROUND OF THE INVENTION

1. Field of the Invention

This invention relates to a novel liquid composition which is useful in automatic glasswashing machines and effectively cleans glassware while having the property of being low-foaming in both unheated and heated water.

2. Description of the Prior Art

Automatic equipment for washing glassware is known; such equipment is usually used by restaurants and the like, and is capable of washing, for example, from 1,500 to 4,000 glasses per hour, typically using a cycle time of about 1 minute.

It has been customary, in the operation of such equipment, to use hot water, i.e., water at a temperature of 130° to 160° F. The use of water at such a temperature improves the washing action but has the drawback of imposing an energy requirement. In light of the current energy crisis, this is undesirable. Perhaps the greatest obstacle to the development of a suitable detergent composition, capable of washing glasses in a commercial glass-washing machine with the use of room-temperature water, has been the consideration that it is desirable to use a nonionic surfactant which will provide adequate detergency in conjunction with a substantial proportion of caustic (sodium hydroxide and/or potassium hydroxide), but there are usually considerable difficulties in respect to (a) getting the nonionic surfactant to be stable in and compatible with the aqueous caustic comprising a substantial proportion of the remainder of the composition and (b) obtaining a composition which is satisfactorily low-foaming. In general, the non-ionic surfactants are more soluble in cold water than in hot water, and it is generally true that at lower water temperatures, they are higher-foaming. The development of a satisfactory composition based upon caustic, water, and low-foaming non-ionic surfactant is, accordingly, a challenging problem.

It may also be taken as known from U.S. Pat. No. 3,956,161 that it is possible to making cleaning compositions which contain water, alkali such as 10 to 30 weight percent of sodium hydroxide, 2 to 6 weight percent of nonionic surfactant, and (as a hydrotrope or solubilizing agent for the nonionic surfactant) 2 to 10 weight percent of alkali-metal salt of a $C_{21}$ dicarboxylic acid. The patent teaches the desirability of using such a composition when low foaming is desired, but it does not give any teaching of how to meet the extremely stringent lowfoaming requirements of a process for machine washing of glassware with water at about 50° to 110° Fahrenheit, while maintaining adequate detergency.

SUMMARY OF THE INVENTION

A composition affording satisfactory performance in commercial glassware-cleaning equipment, operating with room-temperature water, is obtained with a composition containing not only a satisfactory proportion of caustic but also a very low-foaming nonionic surfactant and, as a solubilizer for such surfactant, a cycloaliphatic $C_{21}$ dicarboxylic acid or one of its alkali-metal or ammonium salts.

DESCRIPTION OF THE PREFERRED EMBODIMENTS

There will be described herein first how a composition in accordance with the invention is made and second, how such a composition is used.

A composition according to the present invention is made by the mixing of appropriate quantities of water, caustic, low-foaming nonionic surfactant, cycloaliphatic $C_{21}$ diacid or appropriate alkali-metal or ammonium salts thereof, and possibly one or more optional ingredients. Such optional ingredients may include, for example, sodium silicate, citric acid, dyes, perfumes, and stabilizers.

For obtaining a satisfactory glass-washing effect, it is usually necessary that the composition contain five to thirty weight percent of sodium hydroxide and/or potassium hydroxide. Usually, from considerations of solubility, it is desirable not to go over twenty weight percent in respect to sodium hydroxide. Preferably there is used a composition containing about two to eight percent by weight of sodium hydroxide, e.g., 4 to 16 percent of 50% liquor, and 5 to 8 percent by weight of potassium hydroxide, e.g., about 11 to 18% of 45% liquor. Very satisfactory results have been obtained with the use of an aqueous composition containing 7.2 percent by weight of sodium hydroxide and about 6.5 percent by weight of potassium hydroxide.

Compositions according to the invention also contain 0.5 to 5.0 percent by weight of a very low-foaming nonionic surfactant of the kind herein specified. A very low-foaming nonionic surfactant is one which has an HLB number such as 0.9 to 1.8 (see *Nonionic Surfactants,* edited by Martin J. Schick, Marcel Dekker, Inc., New York, 1967, pages 606–611, for further discussion with regard to HLB number.) As will be seen, not all known nonionic surfactants of such low HLB number are satisfactory. Preferably, there is used a block copolymer, such as one described in U.S. Pat. No. 2,979,528, based upon ethylene diamine and containing, adjoined to the nitrogens of the ethylenediamine, oxypropylene units to a typical molecular weight of 6500 to 7000, as well as, outboard of said oxypropylene units, oxyethylene units to an average molecular weight, in the total molecule, of approximately 8 to 12 percent. Such a product is sold by BASF Wyandotte Corporation, Wyandotte, Michigan, under the designation ∓TETRONIC 1501" surfactant and has an HLB value of 1.0. Suitable results may in some circumstances be obtained with the use of a very low-foaming nonionic surfactant of similar nature, except that the typical molecular weight of the oxypropylene hydrophobe unit is 5500 to 6000; such material is sold by the same corporation under the designation "TETRONIC 1301" surfactant and has an HLB value of 1.5. In general, satisfactory results are not obtained with a nonionic surfactant having an HLB value as high as 1.8, such as sorbitan trioleate, sold commercially under such names as "Span 85" and "Arlacel 85". More usually, compositions according to the present invention contain 1.0 to 2.5 percent by weight of a very low-foaming nonionic surfactant having an HLB number of about 1.0 to 1.5, and in a preferred example, they contain 2.0 weight percent of the composition designated herein above as "TETRONIC 1501" surfactant.

The nonionic surfactants discussed above are of exceedingly hydrophobic nature; they are insoluble in water at any temperature above about 65° F, and their ability to be solubilized is, in general, further impeded and diminished when the water contains, as indicated above, a substantial proportion of caustic. It is necessary, in accordance with the present invention that the composition also contain a suitable proportion of an agent capable of solubilizing into the aqueous caustic-containing composition a nonionic surfactant of the kind indicated above. As will be apparent from certain comparison-test results presented hereinbelow, it is difficult to find a hydrophobe material which will effect solubilization, and will at the same time not render the resulting composition too high-foaming.

In respect to the determination of the foaming properties of compositions containing nonionic surfactants, there was used in connection with the development of the present invention a blender test, in accordance with which 200 milliliters of an aqueous composition containing 0.3 weight percent of active ingredients was agitated, while at 77° Fahrenheit, at high speed in said blender equipment for a period of time of 15 seconds, and there was measured the height of the foam, taking a reading in millimeters, and thereafter, there was observed the length of time which elapsed until the foam had substantially completely subsided. In the development of the present invention, it has been considered desirable that in such a test, the composition involved will not give a foam height greater than 18 millimeters, nor a breakdown time greater than 20 seconds.

In order to achieve solubilizing and low-foaming properties of the kind indicated above, there is included, in accordance with the present invention, an addition of a cycloaliphatic $C_{21}$ dicarboxylic acid or salt of the formula

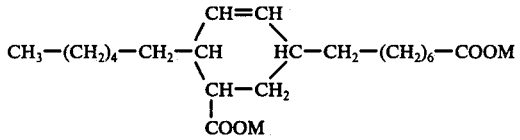

where M is selected from the group consisting of H, Na, K, and $NH_4$—. When M equals in each case hydrogen, the compound may be used in an amount of 0.2 to 10.0 weight percent, preferably about 1.0 to 2.0 weight percent. In a specific composition in accordance with the invention satisfactory results are obtained with the use of 1.5 weight percent of such material. The commercially available "Westvaco Diacid 1500" synthetic corresponds to the case where each M equals hydrogen.

Still other ingredients may optionally be included.

For the purpose of improving the detergency action and protecting the integrity of metal equipment, especially equipment made of aluminum, it is frequently desirable to add a substantial proportion, such as up to 13.0 percent by weight, of silicon dioxide or its equivalent proportion of soluble silicate. In the preferred embodiment of the invention, there is used from 14.0 to 18.0 percent by weight of an aqueous solution of sodium silicate having an $SiO_2/Na_2O$ ratio of 2.38. In a specific example according to the invention, there is used 16.3 percent by weight of such sodium silicate of 2.38 ratio.

Silicate, such as mentioned above, is known as a builder in detergent compositions, and so are citric acid and its alkali-metal salts. Thus, according to the invention, compositions to be used may contain, as an optional ingredient, 3.0 to 5.0 percent by weight of citric acid, or in a preferred case 4.0 percent of citric acid; in a suitable case, an equivalent weight of sodium citrate or potassium citrate may be used.

There are certain other builders, such as sodium pyrophosphate, which preferably are not used in the practice of this invention. Sodium pyrophosphate is preferably avoided because it generates an ecology problem (promoting overgrowth of algae) unless particular and costly measures are taken with respect to the treatment of the water discharged. Moreover, sodium pyrophosphate appears to promote foaming to an undesirable extent. It is certainly preferable to use, as indicated hereinabove, sodium silicate and citric acid as builders, for their use generates no such problem. Moreover, the other organic chemicals mentioned hereinabove are considered generally adequately biodegradable, so that the compositions produced in accordance with the present invention have the advantage that they may be used without the likelihood of requiring expensive treatment of the waste water in order to comply with pollution-control regulations.

The remainder of the composition made in accordance with the present invention is water. Although distilled or deionized water may be used, in most instances, ordinary tap water will suffice, especially if it is not particularly hard. In some instances, a moderate degree of hardness in the water used affords an advantage, aiding in the control of foaming and lowering the temperature of the wash water that can be used. The hardness of the wash water must also be taken into account. It is generally undesirable for the total mixture of detergent and wash water to exceed a hardness of about 20 grains per gallon (about 340 parts per million). Satisfactory results have been obtained even with water of 255 ppm. hardness.

No particular procedure is required for the making of the composition in accordance with the present invention. Ordinarily, the ingredients may be mixed in any desired order at room temperature in any suitable container, subject to the proviso that sodium silicate should be added to a mixture having a basic (higher than 7) pH.

Compositions made as indicated above are used in automatic glasswashing equipment in which the detergent solution is sprayed or otherwise applied onto the glasses or the like to be washed. In accordance with a preferred manner of practicing the present invention, minimum washing temperature is approximately 77° Fahrenheit, although satisfactory results may in certain circumstances be obtained at temperatures as low as 50° Fahrenheit. Such equipment washes 1000 pieces per hour or more, and as high as about 4000 pieces per hour. Most present-day commercially available commercial glasswashing equipment operates with washing solution at a temperature anywhere from 130° Fahrenheit to 160° Fahrenheit. Equipment is known in which a lower washing-liquid temperature (among the ones indicated above as being used in commercial equipment) is used, and there is included in the final rinse an appropriate proportion of an iodine-or chlorine-containing bactericide, and it is desirable, in accordance with the practice of the present invention, to provide a bactericidal final rinse. The exact nature of the final bactericidal rinse is, however, not of the essence of the present invention; any satisfactory bactericidal rinse or other bactericidal practice may be used. The aqueous compositions made according to the present invention are when used, mixed with water of the appropriate temperature to form a washing liquid. Such liquid ordinarily contains 0.2 to 0.5 percent of said compositions.

In its method aspect, the present invention, involving the use of compositions of the kind indicated above in the commercial washing of glasses, using a washing-liquid temperature such as 77° Fahrenheit, has a distinct advantage over the prior art. A major factor in the operating cost of the operation of commercial glass-washing machinery is the cost of providing the hot water required, and with the present invention, it is possible to obtain satisfactory results with only a very mild warming of the water, or in some circumstances, with none at all.

The invention is illustrated by the following specific examples, which are to be taken as illustrative and not in a limiting sense. In the examples, parts are by weight unless otherwise specifically indicated.

EXAMPLE 1

There is made a composition consisting of 51.300 parts of water, 10.400 parts of a caustic-soda liquor containing 50 weight percent of sodium hydroxide, 16.300 parts of an aqueous sodium silicate composition (2.38 ratio), 14.500 parts of a liquor containing 45 weight percent of potassium hydroxide, 4.00 parts by weight of anhydrous citric acid, 1.50 parts of cycloaliphatic $C_{21}$ dicarboxylic acid as sold under the designation "Westvaco Diacid 1550", and 2.0 parts of very low-foaming nonionic surfactant of the kind indicated above as being sold under the designation "TETRONIC 1501" surfactant. The above ingredients were mixed by stirring them together at room temperature, and the composition thereby obtained was used successfully in a commercial glass-washing machine, yielding satisfactory detergency and low-foaming properties with the use of substantially roomtemperature water.

The low-foaming properties of this composition will be appreciated from the results obtained when it was subjected to a blender test of the kind indicated above: a foam height of 13 millimeters and a collapse time of six seconds.

EXAMPLE 2

Example 1 was repeated, except that there was used in place of the "TETRONIC 1501" surfactant mentioned above the "TETRONIC 1301" surfactant mentioned above. The results were the same, except that in the blender test, the foam height was 17 millimeters and the collapse time was ten seconds.

COMPARISON TESTS A TO P

Example 1 was repeated, except that various other nonionic surfactants, hereinbelow identified as A through P, respectively, were used in place of the "TETRONIC 1501" surfactant. Moreover, only blender tests were performed, and in each case, the results are to be considered unsatisfactory. The results are presented below in Table I.

Table I

| Surfactant | Foam Height, mm. | Collapse Time, sec. |
|---|---|---|
| A | 20 | 22 |
| B | 22 | 37 |
| C | 28 | over 60 |
| D | 19 | over 60 |
| E | 19 | over 60 |
| F | 24 | over 60 |
| G | 27 | over 60 |
| H | 28 | over 60 |
| I | 28 | over 60 |
| J | 25 | over 60 |
| K | 35 | over 300 |

Table I-continued

| Surfactant | Foam Height, mm. | Collapse Time, sec. |
|---|---|---|
| L | 34 | over 60 |
| M | 27 | over 60 |
| N | 37 | over 60 |
| O | 35 | over 60 |
| P | 9 | over 60 |

Identification of surfactants A through P, inclusive.

A — a block copolymer made by first oxypropylating and then oxyethylating ethylenediamine to a typical molecular weight of the oxypropylene hydrophobe of 4500 to 5000, oxyethylene units comprising approximately 10 percent in the total molecule.

B — a material as defined in A, except that the typical molecular weight of the oxypropylene hydrophobe is 3500 to 4000.

C — a material as defined in A, except that the typical molecular weight of the oxypropylene hydrophobe is 2500 to 3000.

D — a block copolymer made by first oxypropylating and then oxyethylating propylene glycol, the typical molecular weight of the oxypropylene portion being 4000 and the polyoxyethylene portion of the molecule comprising approximately 10 percent of the total molecule.

E — a nonionic surfactant as defined in D, except that the molecular weight of the oxypropylene hydrophobe is about 3250.

F — a nonionic surfactant as defined in D, except that the typical molecular weight of the oxypropylene hydrophobe is about 2250.

G — a nonionic surfactant made by first oxyethylating and then oxypropylating ethylene glycol, to produce a block copolymer in which the typical total molecular weight of the oxypropylene hydrophobe unit is approximately 3100 and the oxyethylene units comprise 10 percent of the molecule.

H — a hydrophobic nonionic surfactant which is an alkoxylated triol having an approximate average molecular weight of 3900.

I — a hydrophobic nonionic surfactant which is an alkoxylated triol, having an average molecular weight of 3200.

J — another hydrophobic nonionic surfactant which is an alkoxylated triol, having an average molecular weight of 4600.

K — a nonionic surfactant made by adding an average of five moles of ethylene oxide to octylphenol.

L — a nonionic surfactant which is a modified polyethylated straight chain alcohol.

M — a nonionic surfactant which is a modified ethoxylate.

N — a nonionic surfactant which is an aliphatic polyether.

O — a nonionic surfactant which is an aliphatic polyether.

P — a nonionic surfactant which is an oxyethylated nonylphenol.

COMPARISON TESTS Q TO Z

Example 1 was repeated, except that an attempt was made to replace the cycloaliphatic $C_{21}$ dicarboxylic acid with various agents designated Q through Z. If a soluble mixture could be obtained without the addition of more than 10 weight percent of the solubilizing agent, a blender test was conducted. No use tests were conducted. The results of these tests are presented below in Table II.

Table II

| Agent | Proportion Required to Solubilize 2.0% of Nonionic Surfactant, % | Foam Height, mm. | Collapse Time, Sec. |
|---|---|---|---|
| Q | over 10 | | |
| R | over 10 | | |
| S | over 10 | | |
| T | over 10 | | |
| U | 2.0 | 17 | over 120 |
| V | over 10 | | |
| W | over 10 | | |
| X | over 10 | | |
| Y | 5.0 | 40 | over 120 |
| Z | over 10 | 9 | over 120 |

the agents mentioned in the above table are identified as follows.

Q is propylene glycol.
R is isopropanol.
S is a commercially available alkali-compatible nonionic surfactant.
T is sodium xylene sulfonate.
U is bisodium n-lauryl beta-iminodipropionate.
V is sodium n-decyl diphenyl-ether disulfonate.
W is sodium mono- and di-methylnaphthylsulfonate.
X is a linear alkyl naphthalenesulfonate.
Y is a free acid of an organic phosphate ester.
Z is a free acid of an organic phosphate ester.

The foregoing tests demonstrate that the selection of appropriate ingredients to obtain a satisfactory composition is not an easy task. Many combinations do not yield a composition in which the nonionic surfactant is solubilized, and of the ones that do, most are too high-foaming. Thus, compositions according to the invention constitute an unobvious and valuable contribution to the art.

There is thus made, according to one aspect of the invention, a low-foaming and homogeneous composition, useful for the machine washing of glassware at a rate greater than 1,000 pieces per hour with the use of water at temperatures as low as 40° Fahrenheit, consisting essentially of 1. a small amount, effective to promote detergency and sheeting action, of a hydrophobic nonionic surfactant, said nonionic surfactant being a block copolymer of ethylene diamine reacted first with propylene oxide to an average molecular weight of the oxypropylene hydrophobe of 5500 to 7000 and then with ethylene oxide to an extent such that oxyethylene units constitute about 8 to 12 percent of the weight of the average molecule of such copolymer, 2. an effectively solubility-promoting amount of a solubilizing compound having the formula

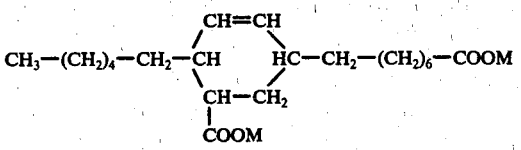

wherein M is independently an ion selected from the group consisting of hydrogen, sodium, potassium, and ammonium, 3. 5 to 30 weight percent of alkali-metal hydroxide selected from the group consisting of sodium hydroxide, potassium hydroxide, and mixtures thereof but not more than 20 weight percent of sodium hydroxide, and 4. water.

In a preferred aspect, the composition also contains sodium silicate and/or citric acid or its Na, K, or $NH_4$ salts as builders. In another aspect, the invention may be considered in method terms, comprising the use of compositions as defined above in the machine washing of glassware, under conditions as indicated above, wherein a bactericidal final rinse is practiced because of the use of relatively cold water.

Those skilled in the art will perceive that the principles of the foregoing invention are not necessarily strictly limited to the machine washing of glassware; in other instances such as for the washing of other wares (including dishes) in which an effective but low-foaming detergent composition for warewashing done with substantially room-temperature water is desired, it is likely to be possible to utilize a composition of alkali-metal hydroxide, amine-based nonionic surfactant of the class described, $C_{21}$ dicarboxylic acid salt as hydrotrope, and water, substantially as described above.

While there have been shown and described herein certain embodiments of the present invention, it is intended that there be covered as well any change or modification therein which may be made without departing from the spirit and scope of the invention.

The embodiments of the invention in which an exclusive property or privilege is claimed are defined as follows:

1. A composition consisting essentially of 1. a small amount, effective to promote detergency and sheeting action, of a hydrophobic nonionic surfactant, said nonionic surfactant being a block copolymer of ethylene diamine reacted first with propylene oxide to an average molecular weight of the oxypropylene hydrophobe of 5500 to 7000 and then with ethylene oxide to an extent such that oxyethylene units constitute about 8 to 12 percent of the weight of the average molecule of such copolymer, 2. an effectively solubility-promoting amount of a solubilizing compound having the formula

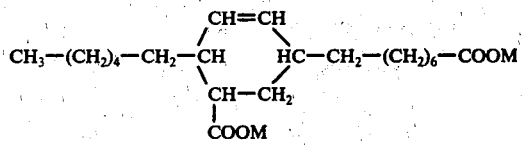

wherein M is independently an ion selected from the group consisting of hydrogen, sodium, potassium, and ammonium, 3. 5 to 30 weight percent of alkali-metal hydroxide selected from the group consisting of sodium hydroxide, potassium hydroxide, and mixtures thereof but not more than 20 weight percent of sodium hydroxide, and 4. water.

2. In the machine washing of glassware at a rate greater than 1,000 pieces per hour, the improvement which comprises using a washing liquid containing 0.2 to 0.5 weight percent of a composition according to claim 1, said washing liquid being at a temperature about 50° to 110° Fahrenheit.

3. A composition as defined in claim 1, wherein said hydrophobic nonionic surfactant is present to an extent of 0.5 to 5.0 percent and said solubilizing compound is present to the extent of 0.2 to 10 weight percent.

4. A composition as defined in claim 3, wherein said composition further contains as a builder a substance selected from the group consisting of citric acid and its sodium, potassium and ammonium salts, said builder being present to an extent of the equivalent of 3 to 10 percent by weight of citric acid.

5. A composition as defined in claim 4, wherein said composition also contains the equivalent of 3 to 13 weight percent of silicon dioxide as a builder.

6. In the machine washing of glassware at a rate greater than 1,000 pieces per hour, the improvement which comprises using a washing liquid containing 0.2 to 0.5 weight percent of a composition according to claim 5, said washing liquid being at a temperature as low as 40° Fahrenheit.

7. A composition as defined in claim 1, wherein said composition also contains sodium silicate to an extent the equivalent of 3 to 13 weight percent of silicon dioxide, as a builder.

8. A composition as defined in claim 1, wherein said composition contains 2 to 8 weight percent of sodium hydroxide, and 5 to 8 weight percent of potassium hydroxide.

9. In the machine washing of glassware at a rate greater than 1,000 pieces per hour, the improvement which comprises using a washing liquid containing 0.2 to 0.5 weight percent of a composition according to claim 8, said washing liquid being at a temperature about 50° to 110° Fahrenheit.

10. A composition as defined in claim 8, wherein said hydrophobic nonionic surfactant is present to an extent of 0.5 to 5.0 percent and said solubilizing compound is present to the extent of 0.2 to 10 weight percent.

11. In the machine washing of glassware at a rate greater than 1,000 pieces per hour, the improvement which comprises using a washing liquid containing 0.2 to 0.5 weight percent of a composition according to claim 10, said washing liquid being at a temperature about 50° to 110° Fahrenheit.

12. A composition according to claim 10, wherein said hydrophobic nonionic surfactant is present to an extent of 0.5 to 5.0 percent and said solubilizing compound is present to the extent of 0.2 to 10 weight percent.

13. A composition as defined in claim 12, wherein said composition further contains as a builder a substance selected from the group consisting of citric acid and its sodium, potassium and ammonium salts, said builder being present to an extent of the equivalent of 3 to 10 percent by weight of citric acid.

14. In the machine washing of glassware at a rate greater than 1,000 pieces per hour, the improvement which comprises using a washing liquid containing 0.2 to 0.5 weight percent of a composition according to claim 13, said washing liquid being at a temperature about 50° to 110° Fahrenheit.

* * * * *